US008215146B2

(12) United States Patent
Shore

(10) Patent No.: US 8,215,146 B2
(45) Date of Patent: Jul. 10, 2012

(54) METHOD OF ROLLING FEED PRODUCTS INTO DIFFERENT SIZED FINISHED PRODUCTS

(75) Inventor: T. Michael Shore, Princeton, MA (US)

(73) Assignee: Siemens Industry, Inc., Alpharetta, GA (US)

( * ) Notice: Subject to any disclaimer, the term of this patent is extended or adjusted under 35 U.S.C. 154(b) by 550 days.

(21) Appl. No.: 12/548,686

(22) Filed: Aug. 27, 2009

(65) Prior Publication Data

US 2011/0048093 A1 Mar. 3, 2011

(51) Int. Cl.
*B21B 39/00* (2006.01)
*B21B 13/08* (2006.01)
*B21B 31/08* (2006.01)

(52) U.S. Cl. ..... 72/226; 72/234; 72/238

(58) Field of Classification Search ..... 72/224, 72/225, 226, 234, 235, 237, 238
See application file for complete search history.

(56) References Cited

U.S. PATENT DOCUMENTS 3,336,781 A 8/1967 Wilson
5,595,083 A 1/1997 Shore

FOREIGN PATENT DOCUMENTS

EP 1048367 A2 11/2000
EP 1110630 A1 6/2001
EP 1958710 A1 8/2008

OTHER PUBLICATIONS

PCT International Search Report dated Feb. 15, 2011 corresponding to PCT Patent Application No. PCT/US2010/046748 filed Aug. 26, 2010 (11 pages).

*Primary Examiner* — Teresa M Ekiert

(57) ABSTRACT

A feed product is rolled into different sized finished products in a rolling mill finishing section which comprises a plurality of modular rolling units arranged along the mill pass line. Each rolling unit includes two roll stands with work rolls configured to define successive oval and round roll passes. The roll stands are designed to effect specific area reductions on products rolled through their respective oval and round roll passes. Feed products having the same entry size are rolled into finished products having different reduced sizes by providing altered rolling sequences in which a selected rolling unit is replaced along the pass line with rolling units having roll stands designed to effect area reductions that differ from those of the roll stands of the replaced rolling unit. Rolling units downstream from the replaced rolling unit are removed from the pass line. The roll stands of rolling units upstream from the replaced rolling unit remain unchanged.

5 Claims, 6 Drawing Sheets

METHOD OF ROLLING FEED PRODUCTS INTO DIFFERENT SIZED FINISHED PRODUCTS

BACKGROUND

1. Field of the Invention

This invention relates to rolling mills producing hot rolled rod and bar products, and is concerned in particular with an improved and more efficient method of operating the finishing sections of such mills.

2. Description of the Prior Art

In a conventional rolling mill finishing section, a typical example of which is described in U.S. Pat. No. 3,336,781 and diagrammatically depicted at 10 in FIG. 3, roll stands $S_1$-$S_{10}$ are arranged in block form along the mill pass line PL. The work rolls of the successive roll stands define alternating oval and round roll passes "O", "R", with the axes of the successive roll pairs being staggered by 90° to thereby provide twist-free rolling.

Feed products $FP_1$ are received from an upstream intermediate mill section (not shown) and are rolled into finished products $FP_2$ in all or some of the successive roll passes $S_1$-$S_{10}$.

FIG. 4 is a rolling diagram depicting how the finishing section of FIG. 3 is typically employed to roll different sized finished products from feed products having the same or different entry sizes. For example, in one rolling sequence, all of the roll stands $S_1$-$S_{10}$ are employed to roll a feed product having a 17.1 mm diameter into a finished product having a 5.5 mm diameter. In another rolling sequence, the roll passes of roll stands $S_7$-$S_{10}$ have been rendered inoperative, for example, by replacing their work rolls with guides (a procedure commonly referred to as "dummying"). In addition, most if not all of the work rolls defining the roll passes of roll stands $S_1$-$S_6$ have been changed to thereby accommodate rolling of the same sized feed product into a finished product having a 9.0 mm diameter.

In still another rolling sequence, the roll passes of roll stands $S_5$ and $S_6$ are additionally dummied, with appropriate changes to the work rolls of the roll passes of roll stands $S_1$-$S_4$ in order to roll the same sized feed product into a finished product having a diameter of 11.5 mm.

It will be seen, therefore, that by progressively dummying roll passes, three different finished products sizes (5.5 mm, 9.0 mm, and 11.5 mm) are rolled from a feed product having the same entry size (17.1 mm). This rolling of different sized finished products from the same sized feed product is commonly referred to as "single family" rolling.

However, a problem with this conventional rolling methodology is that only a relatively narrow range of finished product sizes can be produced from one entry size. Thus, as shown in FIG. 4, four different entry sizes (17.1 mm, 18.5 mm, 19.5 mm, and 21.0 mm) are required to roll finished products ranging from 5.5 mm to 16.0 mm. When shifting from one entry size to another, in addition changing the rolls of some or all of the roll stands in the finishing section, changes also must by made to the rolls and guides of roll stands in upstream sections of the mill. This can take up to an hour, during which time the mill is inoperative and unproductive.

The primary objective of the present invention is to expand the range of sizes of finished products that can be rolled from the same sized feed product, thus advantageously reducing the number of differently sized feed products required to produce a given range of finished products.

A companion objective of the present invention is to broaden the range of finished product sizes that can be rolled from each feed product size.

SUMMARY OF THE INVENTION

In accordance with the present invention, a feed product is rolled into different sized finished products in a rolling mill finishing section which comprises a plurality of rolling units arranged along the mill pass line. Each rolling unit includes two roll stands with work rolls configured to define successive oval and round roll passes. The roll stands are designed to effect specific area reductions on products rolled through their respective oval and round roll passes.

Feed products having a given entry size are rolled through the roll passes of the roll stands of all of the rolling units in a first rolling sequence to produce finished products having a first reduced size. Feed products having the same entry size are rolled into finished products having different reduced sizes by providing altered rolling sequences in which a selected rolling unit is replaced along the pass line with rolling units having roll stands designed to effect area reductions that differ from those of the roll stands of the replaced rolling unit. Rolling units downstream from the replaced rolling unit are removed from the pass line. The roll stands of rolling units upstream from the replaced rolling unit remain unchanged.

These and other features and attendant advantages of the present invention will now be described in greater detail with reference to the accompanying drawings, wherein:

DETAILED DESCRIPTION

Figure 1:
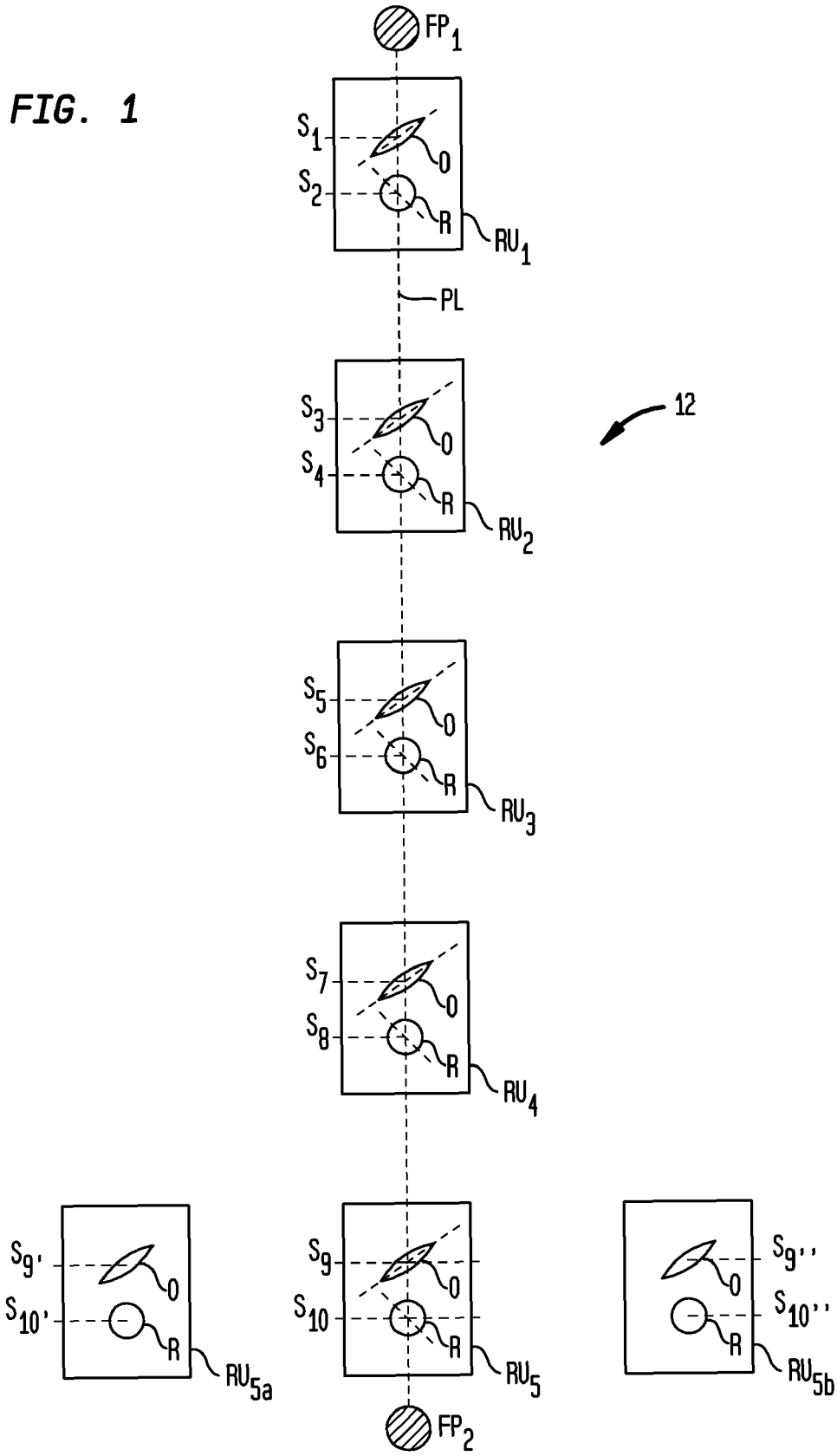
FIG. 1 is a diagrammatic illustration of a modular type rolling mill finishing section used in practicing the method of the present invention.

With reference initially to FIG. 1, a modular type finishing mill 12 comprises a plurality of rolling units $RU_1$-$RU_5$ arranged along a mill pass line PL. Each rolling unit includes two of a series of roll stands $S_1$-$S_{10}$. The work rolls of the successive roll stands are configured to define successive oval and round roll passes "O", "R", and each roll stand is designed to effect a specific area reduction on products rolled through its respective roll pass.

In addition to the rolling units $RU_1$-$RU_5$, the modular finishing mill 12 includes rolling units $RU_{5a}$ and $RU_{5b}$. The rolling units are shiftable onto and off of the pass line PL along tracks (not shown) in a conventional manner known to those skilled in the art, and as described for example in U.S. Pat. No. 5,595,083, the description of which is herein incorporated by reference.

Figure 2A:
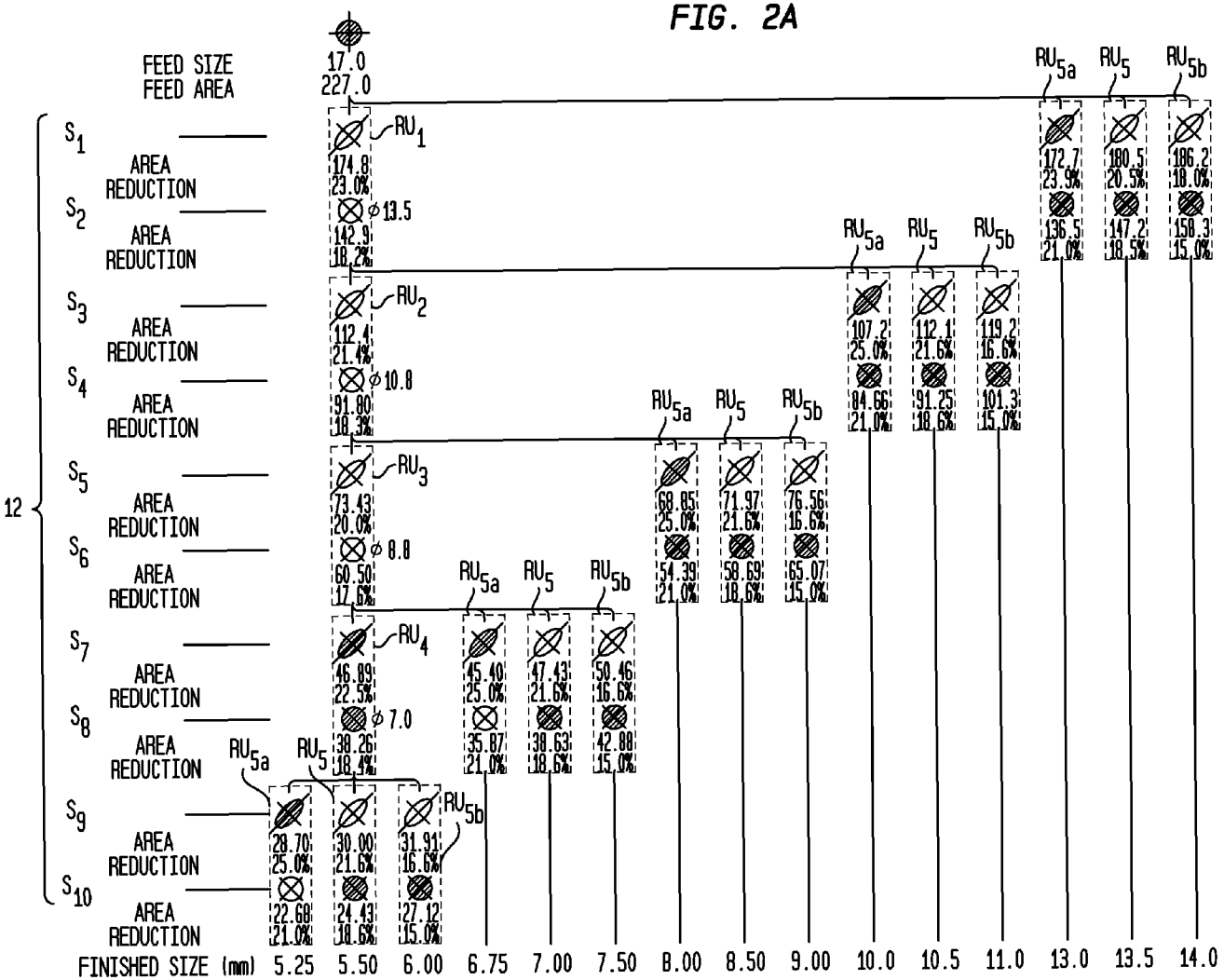
FIGS. 2A and 2B are rolling diagrams illustrating the method of rolling of the present invention.
Figure 2B:
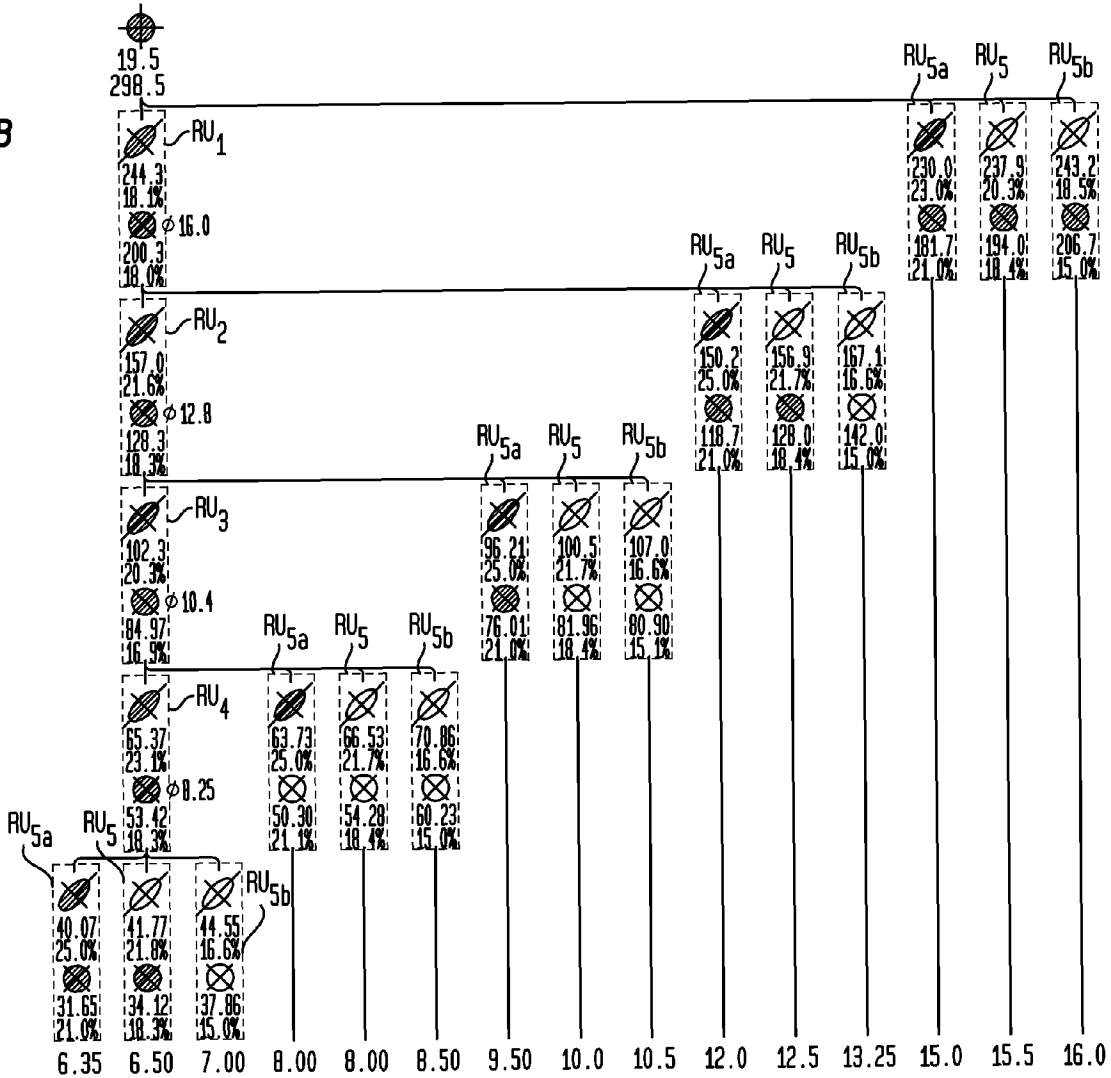
Figure 3:
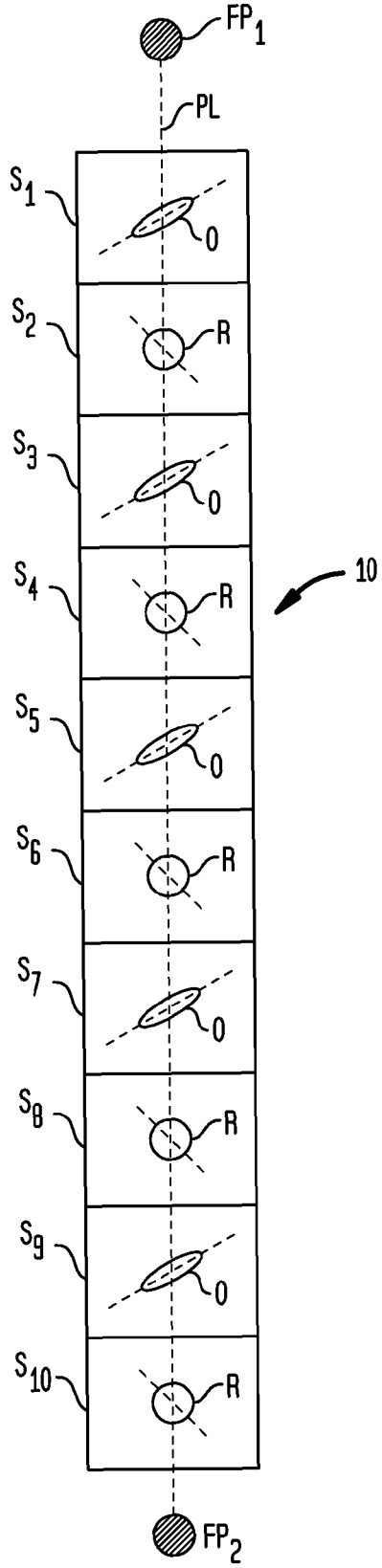
FIG. 3 (PRIOR ART)
FIG. 3 is a diagrammatic illustration of a conventional block type finishing mill.
Figure 4A:
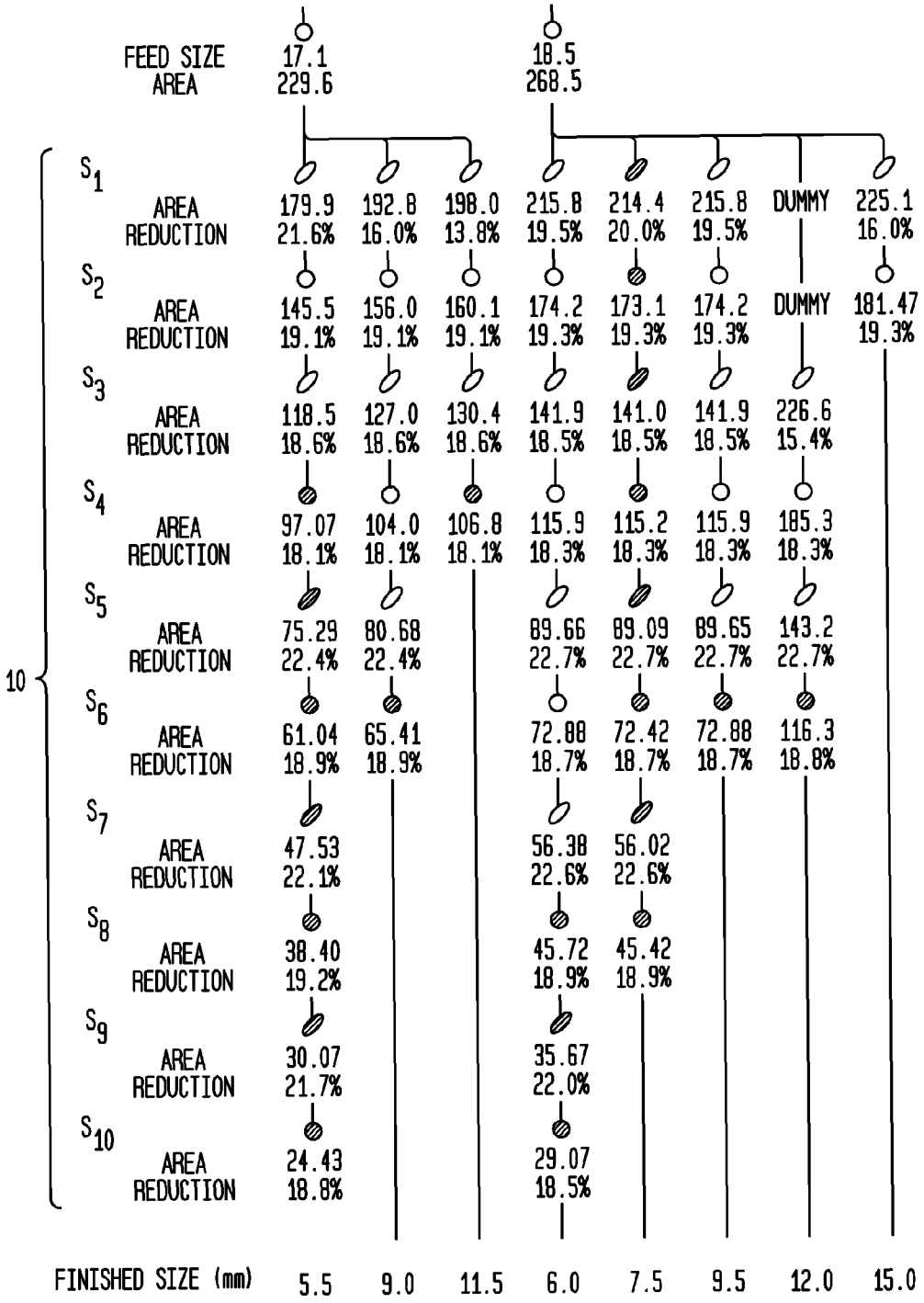
FIG. 4A (PRIOR ART)
FIGS. 4A and 4B are rolling diagrams depicting a conventional method of rolling with the finishing mill depicted in FIG. 3.
Figure 4B:
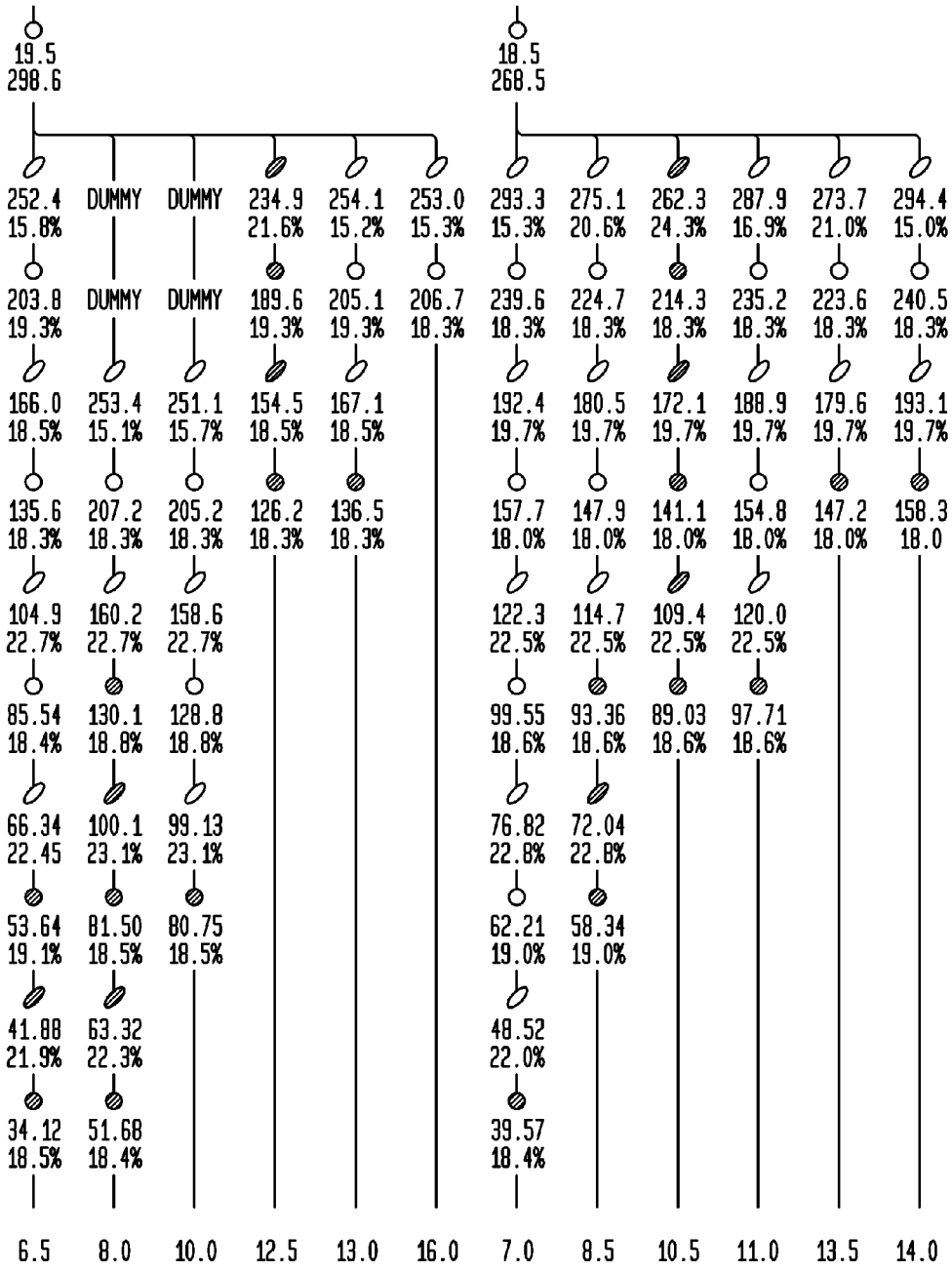
FIG. 4B (PRIOR ART)

FIG. 2 illustrates a typical rolling diagram for the modular type finishing mill shown in FIG. 1. In a first rolling sequence, rolling units $RU_1$-$RU_5$ are employed to roll a feed product $FP_1$ having a diameter of 17.0 mm into a finished product $FP_2$ having a diameter of 5.5 mm. The roll stands $S_9$ and $S_{10}$ of the last rolling unit $RU_5$ are designed to effect area reductions respectively of 21.6% and 18.6%.

In an altered rolling sequence, rolling unit $RU_5$ is removed from the pass line and replaced by rolling unit $RU_{5a}$. The roll stands $S_9$ and $S_{10}$ of rolling unit $RU_{5a}$ are designed to effect area reduction respectively of 25.0% and 21.0%, which differ from the area reductions of the roll stands $S_9$, $S_{10}$ of rolling unit $RU_5$. In this altered rolling sequence, in which the roll stands of rolling units $RU_1$-$RU_4$ remain in place and unchanged, the same feed product $FP_1$ is rolled into a finished product having a diameter of 5.25.

In a different altered rolling sequence, rolling unit $RU_5$ is replaced by rolling unit $RU_{5b}$ having roll stands $S_9$, $S_{10}$ designed to effect area reductions respectively of 16.6% and 15.0%. With this rolling sequence, the same feed product $FP_1$ is rolled into a finished product having a diameter of 6.0 mm.

In still other altered rolling sequences, rolling units $RU_4$, $RU_3$, $RU_2$, and $RU_1$ are progressively replaced by rolling units $RU_5$, $RU_{5a}$, and $RU_{5b}$, with the roll stands of the rolling units downstream of the replaced rolling unit having been dummied.

By doing so, the same sized feed product $FP_1$ can be rolled into fifteen different finished product sizes ranging in diameter from 5.25 mm to 14.0 mm.

The same methodology can be employed to roll a feed product $FP_1$ having a diameter of 19.5 mm into fifteen other finished products ranging in diameter from 6.35 mm to 16.0 mm.

It thus will be seen that by employing the modular finishing mill 12 in accordance with the method of the present invention, and as compared to conventional rolling practices with a block type finishing mill 10, a wider range of differently sized finished products can be produced from a smaller number of differently sized feed products. This results in significantly less loss of production time when shifting from one entry size to another.

I claim:

1. A method of rolling a feed product into different sized finished products in a rolling mill finishing section which comprises a plurality of rolling units arranged along a mill pass line, each rolling unit including two roll stands with work rolls configured to define successive oval and round roll passes, and with each roll stand being designed to effect a specific area reduction on products rolled through its respective roll pass, said method comprising:

rolling a feed product having an entry size through the roll passes of the roll stands of the rolling units in a first rolling sequence to thereby produce a finished product having a first reduced size;

replacing a selected rolling unit along said mill pass line with a replacement rolling unit having roll stands designed to effect area reductions that differ from the area reductions effected by the roll stands of said selected rolling unit, and removing from the mill pass line any of said rolling units downstream from said replacement rolling unit to thereby provide an altered second rolling sequence; and rolling a feed product with the same entry size through the roll passes of the roll stands of the rolling units of said second rolling sequence to thereby produce a finished product having a second reduced size different from said first reduced size.

2. The method of claim 1 wherein the selected rolling unit is the last of said rolling units along said mill pass line.

3. The method of claim 1 wherein the selected rolling unit is other than the last of said rolling units along said mill pass line, and the last rolling unit comprises the replacement rolling unit.

4. The method of claim 3 wherein the last rolling unit is one of a multiple of replacement rolling units alternatively substituted for the selected rolling unit.

5. A method of rolling a feed product into different sized finished products in a rolling mill finishing section which comprises a plurality of rolling units arranged along a mill pass line, each of said rolling units having a first pair of work rolls defining an oval roll pass followed by a second pair of work rolls defining a round roll pass, said oval and round roll passes being configured and dimensioned to effect area reductions in a product passing therethrough, said method comprising:

employing said rolling units in a first rolling sequence to roll a feed product having an entry size into a finished product having a first reduced size, replacing a selected one of said rolling units with a substitute rolling unit, and dummying any rolling units downstream of said selected one rolling unit to thereby create an altered second rolling sequence, the roll passes of said substitute rolling unit being configured and dimensioned to effect area reductions that differ from the area reductions effected by the roll passes of said selected one rolling unit, and employing said rolling units in said second rolling sequence to roll a feed product having the same entry size into a finished product having a second reduced size different from said first reduced size.

* * * * *